US006093091A

United States Patent [19]

Keller

[11] Patent Number: 6,093,091

[45] Date of Patent: Jul. 25, 2000

[54] HOLDER FOR FLAT SUBJECTS IN PARTICULAR SEMICONDUCTOR WAFERS

[75] Inventor: Thomas Keller, zur Linnbek, Germany

[73] Assignee: Peter Wolters Werkzeugmaschinen GmbH, Germany

[21] Appl. No.: 09/207,735

[22] Filed: Dec. 8, 1998

[30] Foreign Application Priority Data

Dec. 16, 1997 [DE] Germany ..... 197 55 975

[51] Int. Cl.[7] ..... B24B 47/00

[52] U.S. Cl. ..... 451/388; 451/288; 451/398

[58] Field of Search ..... 451/287, 288, 451/289, 388, 397, 398

[56] References Cited

U.S. PATENT DOCUMENTS

| | | | |
|---|---|---|---|
| 5,216,846 | 6/1993 | Takahashi | 51/326 |
| 5,681,215 | 10/1997 | Sherwood et al. | 451/388 |
| 5,716,258 | 2/1998 | Metcalf | 451/41 |
| 5,795,215 | 8/1998 | Guthrie et al. | 451/286 |
| 5,957,751 | 9/1999 | Govzman et al. | 451/8 |

FOREIGN PATENT DOCUMENTS 195 44 328 5/1996 Germany .

OTHER PUBLICATIONS

Company document "CMP Cluster Tool System Planarization Chemical Mechanical Polishing" of Peter Wolters of Mar. 1996.

*Primary Examiner*—Timothy V. Eley
*Assistant Examiner*—Dung Van Nguyen
*Attorney, Agent, or Firm*—Vidas, Arrett & Steinkraus

[57] ABSTRACT

A holder for flat subjects, in particular semiconductor wafers, in particular in a device for the chemical-mechanical polishing of semiconductor wafers, with a plate-like head which can be connected on the upper side to a height adjustable spindle and at the lower side comprises a holding plate which is coupled to a carrier section arranged above the holding plate via a universal joint and which comprises a number of vertical bores which extend to the lower side of the plate and can be connected to a vacuum and/or a fluid source, wherein the holding plate is height adjustably guided in the carrier section, between the carrier section and the holding plate there is arranged an annular closed membrane within which there is formed an essentially air-tightly closed inner space which can be selectively connected to atmosphere or vacuum or to a pressure source.

13 Claims, 1 Drawing Sheet

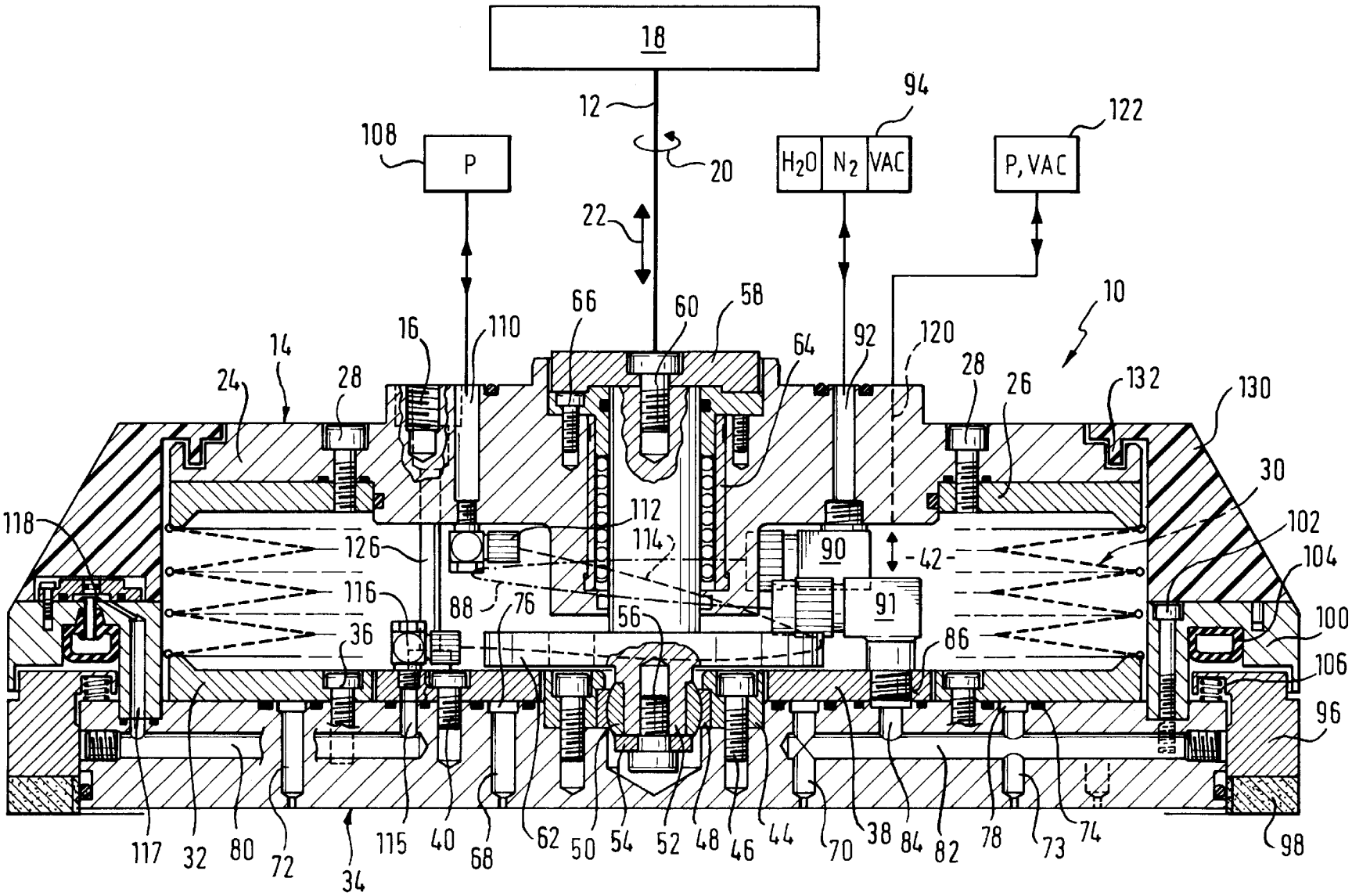
P, VAC
$H_2O$
$N_2$
VAC
P
18
10
12
14
16
20
22
24
26
28
30
32
34
36
38
40
42
44
46
48
50
52
54
56
58
60
62
64
66
68
70
72
73
74
76
78
80
82
84
86
88
90
91
92
94
96
98
100
102
104
106
108
110
112
114
115
116
117
118
120
122
126
130
132

HOLDER FOR FLAT SUBJECTS IN PARTICULAR SEMICONDUCTOR WAFERS

BACKGROUND OF THE INVENTION

The invention relates to a holder for flat subjects, in particular semiconductor wafers, according to the introductory part of claim 1.

In the last years the continuously increasing miniaturization of semiconductor element structures causes more stringent and new demands on the manufacturing process of electronic components. Thus with the lithography procedure with structure sizes below 0.5 $\mu$m the surface of the semiconductor material to be exposed must be very planar (profile difference <0.4 $\mu$) in order to lie within the focussing plane. For this the material must be planarized by way of a suitable device.

From DE 195 44 328 or from the company document "CMP Cluster Tool System Planarization Chemical Mechanical Polishing" of Peter Wolters of March 1996 it is known to provide polishing and cleaning stations for wafers. After polishing, the wafers run through a cleaning station, wherein from the later document it is known to arrange the polishing and cleaning station in a pure space and to separate these from a space from which the semiconductor wafers exit and are put into the pure space from which they exit, with the help of a suitable transfer device. The wafers are held in processing units by holders and are pressed by these holders against the polishing working surfaces. The holders or holding heads are connected to a spindle of a drive machine; the position of the spindle is mounted in a height adjustable manner in order to press the wafers against the working surfaces. In order to obtain an adequate planarity the lower holding plate which holds the wafer via vacuum channels or vacuum bores, is linked via a universal joint onto a carrier section which for its part is connected to the spindle of the drive device. The pressing force is applied exclusively via the universal joint to the holding plate and thus to the wafer. This leads to a relatively high loading of the joint and brings with it the danger that the pressing pressure is not uniformly distributed.

BRIEF SUMMARY OF THE INVENTION

It is the object of the invention to provide a holder for flat subjects, in particular semiconductor wafers with which the subject may be pressed completely uniformly against a working surface.

This object is achieved by the features of patent claim 1.

With the holder according to the invention the holding plate is designed movable in height in the carrier section, and between the carrier section and the holding plate there is arranged an annular closed membrane within which there is formed an essentially air-tight sealed space. The inner space may be selectively connected to a pressure source or to atmosphere or vacuum.

With the holder according to the invention the holding plate is suspended on the carrier section via a membrane which is preferably formed by a metal bellows. The membrane is so formed, and its connection between the carrier section and the holding plate is such that it also transmits onto the holding plate a torque which is transmitted from the drive spindle of the holding drive to the carrier section. The membrane must therefore be sufficiently rotationally rigid. Furthermore it resiliently yields in the axial direction so that independently of the pressure in the inner space of the membrane the relative position of the holding plate to the carrier section is changed.

The receiving of a wafer in a receiving position takes place in the usual manner in that a vacuum is applied to the vertical bores in the holding plate, which then has the effect that the wafer sticks to the lower side of the holding plate. Preferably the receiving of a wafer is effected with a vacuum in the inner space of the membrane; the holding plate assumes its highest position with respect to the carrier section. Subsequently with the help of the spindle the head is sunk onto a working surface, for example the polishing cloth of a polishing plate. The sinking is effected into a position shortly above the working surface. Subsequently pressure is applied in the inner space of the membrane so that the plate presses the received wafer against the working surface. The amount of pressure in the inner space of the membrane determines the working pressure, wherein the return spring force of the flexible membrane is to be taken into account.

Since the membrane may accommodate almost the diameter of the holding plate the pressing pressure may be applied to the holding plate over a large surface. The jointed and height-adjustable mounting of the holding plate on the carrier section is not loaded by the pressing pressure.

One embodiment of the invention provides for the bellows with an upper and a lower annular disk as a unit to be rigidly connected to the upper side of the holding plate and the lower side of a carrier flange. The lower annular disk may therefore have an outer diameter which is only slightly smaller than that of the holding plate so that it may bear on the holding plate with a large surface in order to exert a uniform pressing pressure on the holding plate. With the help of the holder according to the invention therefore a particularly precise processing with a high as possible planarity may be carried out.

A connection of the inner space of the membrane to a pressure source or to atmosphere or vacuum is effected preferably via a vertical channel in the carrier section. Preferably the vertical channel is connected to a vertical channel in the drive spindle and at the upper end of the drive spindle can be connected to a pressure source or to a vacuum via a rotational connection. The incorporation of a channel in the spindle with respect to the connection of the vertical bores in the holding plate with a pressure or a vacuum is known per se. On application of the mounting according to the invention there are therefore provided at least three channels in the spindle, which is dealt with further below.

For connecting a vacuum pump or a pressurized air source or also another fluid source to the vertical bores in the pressure plate preferably there is provided a suitable distributor system. According to one embodiment of the invention this lies in the fact that the vertical bores extend up to the upper side of the holding plate and are arranged on at least one part circle. All upper ends of the bores lying on a part circle are connected to one another via an annular groove in the holding plate, wherein the holding plate in the region of the annular grooves comprises a sealing covering. In the holding plate there is provided at least one transverse bore which is connected to an opening in the covering via a vertical connection bore, the covering for its part being in connection with a bore in the carrier section via a flexible conduit in the inner space of the membrane for the purpose of connection to a fluid source or to a vacuum. The transverse bore is in connection with at least one vertical bore of each part circle. In this manner a uniform suction pressure or excess pressure at the lower opening of the vertical bore in the holding plate may be achieved.

According to the invention the holding plate is also guided in the carrier section in a height-movable manner.

For this one embodiment of the invention provides for a guiding bolt mounted on the holding plate to be guided movable in height in a ball guide of the carrier section. The ball guide provides for a precise and almost friction-free adjustment of the guiding bolt in the carrier section.

In another embodiment of the invention it is provided for a retaining ring which can be brought into engagement with a working surface to surround the holding plate and to be supported on the holding plate via spring arrangements. A pneumatic pressing device of a plate provides for a bearing of the retaining ring on the working surface. Before applying the pressing pressure and the actual processing of the wafer, the retaining ring is pressed against the underlay in order to hold the wafer in the lateral direction within the retaining ring. During the polishing procedure the polishing cloth is pressed forwards. Preferably on the lower side of the retaining ring there is mounted a material of a low friction and a high wear resistance.

As already mentioned the holding plate before receiving a wafer may be moved in the direction of the carrier section. In order to limit this movement according to one embodiment of the invention there is provided an abutment in the inside of the membrane. This abutment is preferably provided with a buffer or a similar damping element in order to effect a damping and to suppress any noise formation.

On embodiment example of the invention is subsequently described hereinafter in more detail.

BRIEF DESCRIPTION OF THE DRAWINGS

The single figure shows a section through a holder according to the invention as well as schematically drawn associated parts.

DETAILED DESCRIPTION OF THE INVENTION

In the drawing a holding head 10 is mounted on a spindle 12. The spindle 12 is not described in any detail. The mounting is effected via screwing with a carrier section 14 which is hereinafter not described in more detail. In the carrier section there is indicated a pocket threaded bore 16 which may serve for a screwing with the spindle 12. The spindle 12 is part of a drive device 18 of an otherwise non-shown device for the mechanical-chemical polishing of a surface of a semiconductor wafer. The spindle 12 is not only rotated as is indicated by arrow 20 but may also be adjusted in height as is indicated by the double arrow 22.

The carrier section 14 comprises a flange 24 on whose lower side there is screwed an annular disk 26 by way of screws 28. To the annular disk 26 there is connected a metallic bellows 30 whose design is not to be described in more detail. The bellows 30 on the lower side is connected to a second annular disk 32 of the same diameter and the same shape. The annular disk 32 is connected to the upper side of a holding plate 34 via screws 36. The holding plate 34 is relatively thick and is precisely ground planar-parallel from a suitable material. The holding plate 34 is circular just as the annular disks 32, 26 and the flange 24.

In the inner opening of the annular disk 32 there is arranged a cover plate 38 which is mounted by way of screws, indicated at 40. In this manner in the inside of the membrane 30 there is formed an essentially gas-tight closed inner space 42.

The plate 34 as can be recognized is suspended on the membrane.

In a recess at the upper side of the holding plate 34 and a central bore of the cover plate 38 there is incorporated a ring 44 and by way of screws 46 is fastened to the plate 34 which retains a bearing shell 48 on the inner side. The bearing shell 48 cooperates with a bearing ball 50 at the lower end of a bearing bolt 52. As can be recognized the ball is pushed onto a section of the bolt 52 which is small in diameter and here via a disk 54 is fastened by a screw 56. The bolt 52 extends upwards through a central bore of the flange 24 and at the upper end is connected to an abutment plate 58 via a screw 60. In the inner space 42 the bolt 52 is extended in a flange-like manner as can be recognized at 62.

In the bore of the flange 24 there is arranged a ball guide 64 which cooperates with the bolt 52 and linearly guides it almost free of friction. The abutment plate 58 cooperates with the head of a screw 66 as an abutment. One thus recognizes that the plate 34 suspended on the membrane is guided in a manner movable in height and may also tilt with respect to the bolt 52. The possible tilting movement is limited by the flange 62 and as a result is minimal.

On two concentric part circles of the holding plate 34 there are arranged vertical bores which are guided through the holding plate 34. On the inner part circle in the Figure the bores 68, 70 are to be recognized and on the outer part circle the bores 72, 73. It is to be understood that also bores on further part circles may be provided as is indicated dashed to the right of bore 73. The bores are guided up to the upper side of the plate 34 where however they are sealed by the annular disk 32 or the cover plate 28. Suitable seals 74 are provided. The bores 68 to 73 open at the upper side of the plate 34 into annular grooves 76 or 78, so that for each part circle the associated vertical bores are in connection with one another. At the lower end the bores 68 to 73 open into nozzle-like openings, until they reach the lower side of the holding plate 34.

In the drawing two transverse bores 80, 82 are to be recognized. The transverse bore 82 connects two vertical bores 70, 73 to one another and therefore creates a connection of all vertical bores of both part circles. The transverse bore 82 is connected to an opening 86 in the covering 38 by a bore 84. A tubing connection indicated at 88 connects a tubing connection 91 at the opening 86 to a tubing connection 90 at the lower side of the flange 24 which itself is connected via a vertical bore 92 to a device 94 with which a vacuum may be suctioned or nitrogen may be entered or water, which is dealt with further below.

At a small distance the holding plate 34 is surrounded by a retaining ring 96 which at its lower side is provided with a sliding section 98 which consists of a material of a low friction and a high wear resistance. The lower side of the section 98 is parallel to the lower surface of the plate 34. Above the retaining ring 96 there is located a bearing ring 100 which is screwed to the upper side of the plate 34 via screws 102. In an annular recess the bearing ring 100 mounts an inflatable tubing 104 which during the inflation bears against the upper side of the retaining ring 96 and which by way of this is pushed downwards against the springs 106 via which the retaining ring 96 is supported on the upper side of the plate 34. The supply of the tubing 104 with pressurized air is effected via the device 108 which is in connection with the vertical bore 110 in the flange 24.

The channel 110 at the lower end is in connection with a connection 112 which via a flexible conduit 114 is in connection with a connection 116 mounted on the plate 38. Via a bore in the plate 38, a bore section 115 in the plate 34 and the transverse bore 80 as well as via a bore 117 in the bearing ring 100 a connection to the tubing 104 is created as is indicated at 118. According to how much pressure is put into the tubing 104 the retaining ring 96 is pressed far downwards to a greater or lesser degree.

Via a bore 120 which is not shown but is drawn broken a device 122 is connected to the inner space 42 of the membrane 30. Via the device 112 pressure may be introduced into the inner space 42 or a vacuum may be applied. The conduits which are led to the devices 94, 108 and 122 are realized by channels in the spindle 12, which via rotating connections are then in connection with the devices 94, 108, 122. According to whether a vacuum is applied to the space 42 or a pressure, the holding plate 34 is more or less displaced in its position. With a vacuum the plate 34 is lifted until it abuts against an abutment 126 within the space 42. The abutment may be provided with a suitable damping material so that no disturbing noises arise. If on the other hand pressure is given to the space 42, the plate 34 is adjusted downwardly, wherein this movement is limited by the abutment of the abutment plate 58 against the bolt 66.

The shown holder functions as follows. By sinking the head 10 onto a readily held wafer with the help of the height adjustable spindle 12 the lower side of the plate 34 comes into engagement with the facing surface of the wafer. Previously the plate 34 has been adjusted into the maximum lifted position by applying a vacuum to the space 42. Shortly before or during the contact with the wafer by way of the device 94 a vacuum is applied to the vertical bores 68 to 73. By way of this the wafer is held on the plate 34 and from now on may be transported to a working surface, for example a polishing plate. Above the polishing plate there is effected a lowering of the head 10 into a predetermined position in which the wafer has a minimal distance to the polishing cloth and as a result does not contact this. Subsequently pressure is given into the space 42 by which means the plate 34 is moved downwards and the wafer is brought into engagement with the polishing cloth. The engagement force (polishing force) is determined by the pressure in the chamber 42. Before this takes place the tubing 104 is impinged with pressure by the device 108 by which means firstly the section 98 comes into engagement with the polishing cloth in order to fix this. Subsequently the head 10 is set into rotation and the polishing procedure begins. During the polishing the vacuum of the device 122 is maintained at the bores 68 to 73. When the polishing procedure is finished, again a vacuum is applied to the space 42 by which means the plate 34 again is lifted somewhat. At the same time the spindle is moved upwards. The drive device is driven into another position in order to deposit the wafer at another location. For this purpose the spindle 12 sinks at the new location and by elimination of the vacuum at the bores 68 to 73, by applying a short knock with nitrogen or likewise the wafer is released from the holding plate 34. It is also possible via the bores 68 to 73 to convey water from the device 94 to the lower side of the plate 34 in order to carry out a cleaning.

It is finally to be stated that at the upper side of the bearing ring 100 there is mounted a cover ring 130 which with a collar 132 directed axially inwards, at the upper end, engages into a corresponding groove of the flange 24. The cover ring 130 protects the inside of the head 100. It has nothing to do with its function.

What is claimed is:

1. A holder for semiconductor wafers, in a device for the chemical-mechanical polishing of semiconductor wafers, with a head comprising a carrier section having an upper side which can be connected to a height adjustable spindle, the carrier section comprising a guide bore therein for receiving a linear guide and a number of vertical through bores and a holding plate arranged below the carrier section and coupled thereto via a universal joint, the holding plate having an upper side and a lower side, the holding plate comprising a number of vertical bores which extend to the lower side of the holding plate and can be connected to a vacuum and/or a fluid source through a bore in the carrier section, the holding plate being linearly height adjustably guided in the carrier section via a linear guide arranged in the guide bore of the carrier section, one and only one angular closed metallic bellows being connected to the carrier section and the holding plate within which an essentially air-tightly closed inner space is formed which can be selectively connected to atmosphere or vacuum or to a pressure source, the universal joint and the linear guide being arranged in the inner space and the guide bore in the carrier section, each bore in the holding plate being interconnected through a flexible line in the inner space to a through bore in the carrier section.

2. A holder according to claim 1, wherein the carrier section has a radial flange and the bellows with an upper and lower annular disk as a unit is rigidly connected to the upper side of the holding plate and the lower side of the carrier flange.

3. A holder according to claim 1, wherein the vertical bores in the plate extend towards the upper side of the holding plate and are arranged on at least one circle, all upper ends of the bores lying on a circle are in connection via an annular groove in the holding plate, wherein the holding plate in the region of the annular grooves is covered by a sealing covering, in the holding plate there is provided at least one transverse bore which via a vertical connection bore is connected to an opening in the covering, which for its part via a flexible conduit in the inner space of the membrane is connected to a bore in the carrier section for the purpose of connection to a fluid source or a vacuum and the transverse bore is in connection with at least one vertical bore of each part circle.

4. A holder according to claim 1, wherein the universal joint is connected to a guiding bolt which is guided in a height movable manner in a ball guidance of the carrier section.

5. A holder according to claim 1 further comprising a retaining ring which can be brought into engagement with a working surface wherein the retaining ring surrounds the holding plate and via spring arrangements is supported on the holding plate via a pneumatic pressing device mounted between the bearing ring and the retaining ring in order to exert a pressure on the retaining ring.

6. A holder according to claim 5, wherein an elastic inflatable tubing is arranged between the bearing ring and the retaining ring, and the tubing via a channel in the bearing ring, a channel in the holding plate, a flexible conduit in the inner space of the bellows and a channel in the carrier section is in connection with a pressure source.

7. A holder according to claim 1, wherein in the inner space of the bellows there is arranged at least one abutment for the limiting of a movement of the holding plate in the direction of the carrier section and is connected to the carrier section.

8. A holder according to claim 7, wherein the abutment comprises a buffer.

9. A holder for semiconductor wafers, in a device for the chemical-mechanical polishing of semiconductor wafers, the holder comprising:

a head having an upper side which can be connected to a height adjustable spindle, and a lower side, the head at the lower side comprising 1) a holding plate which comprises a number of vertical bores which extend to the lower side of the holding plate and can be connected to a vacuum and/or a fluid source, each vertical bore having an upper end, and 2) a carrier section disposed above the holding plate, the holding plate coupled to the carrier section via a universal joint, the holding plate height adjustably guided in the carrier section, wherein between the carrier section and the holding plate there is arranged an annular closed membrane within which there is formed an essentially air-tightly closed inner space which can be selectively connected to atmosphere or vacuum or to a pressure source, and wherein the vertical bores extend towards the upper side of the holding plate and are arranged about at least a part of a circle, all upper ends of the bores lying on the part circle are in connection via an annular groove in the holding plate, the holding plate in the region of the annular grooves is covered by a sealing covering, and in the holding plate there is provided at least one transverse bore which via a vertical connection bore is connected to an opening in the covering, which for its part via a flexible conduit in the inner space of the membrane is connected to a bore in the carrier section for the purpose of connection to a fluid source or vacuum and the transverse bore is in connection with at least one vertical bore of each part circle.

10. A holder according to claim 9, wherein the universal joint has a first side facing the carrier section and a second side facing the holding plate wherein the first side of the universal joint is connected to a guiding bolt which is guided in a height movable manner in a ball guide of the carrier section.

11. A holder according to claim 9, further comprising a retaining ring which can be brought into engagement with a working surface, wherein the retaining ring surrounds the holding plate and via spring arrangements is supported on the holding plate and a pneumatic pressing device is mounted on the holding plate for exerting a pressure onto the retaining ring and wherein to the holding plate there is connected a bearing ring on which there is mounted an elastic inflatable tubing which can be applied against the retaining ring, and the tubing, via a channel in the bearing ring, a channel in the holding plate, a flexible conduit in the inner space of the membrane and a channel in the carrier section is in connection with a pressure source.

12. A holder according to claim 9, wherein in the inner space of the membrane there is arranged at least one abutment for the limiting of a movement of the holding plate in the direction of the carrier section, the abutment connected to the carrier section.

13. A holder according to claim 12, wherein the abutment comprises a buffer.

* * * * *